US010464766B2

(12) United States Patent
Oberdalhoff et al.

(10) Patent No.: US 10,464,766 B2
(45) Date of Patent: Nov. 5, 2019

(54) ROLL-REMOVAL DEVICE, WINDING DEVICE AND METHOD FOR TRANSPORTING AWAY A PLURALITY OF ROLLS WHICH HAVE BEEN WOUND TO COMPLETION

(71) Applicant: Windmöller & Hölscher KG, Lengerich (DE)

(72) Inventors: Tim Oberdalhoff, Lienen (DE); Werner Beckonert, Emsdetten (DE)

(73) Assignee: Windmöller & Hölscher KG, Lengerich (DE)

( * ) Notice: Subject to any disclaimer, the term of this patent is extended or adjusted under 35 U.S.C. 154(b) by 250 days.

(21) Appl. No.: 15/531,902

(22) PCT Filed: Dec. 18, 2015

(86) PCT No.: PCT/EP2015/080435
§ 371 (c)(1),
(2) Date: May 31, 2017

(87) PCT Pub. No.: WO2016/102349
PCT Pub. Date: Jun. 30, 2016

(65) Prior Publication Data

US 2017/0267477 A1 Sep. 21, 2017

(30) Foreign Application Priority Data

Dec. 22, 2014 (DE) ..... 10 2014 226 859

(51) Int. Cl.
*B65H 19/30* (2006.01)
*B65H 19/22* (2006.01)

(52) U.S. Cl.
CPC ..... *B65H 19/30* (2013.01); *B65H 19/2284* (2013.01); *B65H 19/305* (2013.01);
(Continued)

(58) Field of Classification Search
CPC ..... B65H 19/2207; B65H 19/2284; B65H 19/2292; B65H 19/30; B65H 19/305
See application file for complete search history.

(56) References Cited

U.S. PATENT DOCUMENTS 5,810,966 A * 9/1998 Semba ..... B65H 19/2215 156/188
5,911,384 A * 6/1999 Peters ..... B65H 19/2246 242/530.1
5,941,474 A 8/1999 Cushing

FOREIGN PATENT DOCUMENTS

DE 102010003947 A1 10/2010
DE 102013108831 A1 11/2014
(Continued)

OTHER PUBLICATIONS

PCT Notification of Transmittal of Translation of the International Preliminary Report of Patentability dated Jul. 6, 2017, issued for PCT Application No. PCT/EP2015/080435, as well as the English translation document, 8 pages.

*Primary Examiner* — William E Dondero
(74) *Attorney, Agent, or Firm* — Bret E. Field; Bozicevic, Field & Francis LLP

(57) ABSTRACT

The invention describes a roll-removal device by means of which a plurality of rolls which have been wound to completion are transported away from a winding shaft
having a displacement device for displacing the rolls relative to the winding shaft, in order to withdraw the rolls from the winding shaft,
having a receiving device for receiving the rolls, and
having a transfer device for transferring the rolls from the displacement device to the receiving device, wherein the rolls can be rolled freely at least in certain regions, the rolls rolling about their rolling axes.
(Continued)

By means of this device for changing the position of the rolls axes, the roll axes of two adjacent rolls can be moved to an angle of less than 180 degrees in relation to one another.

16 Claims, 6 Drawing Sheets

(52) U.S. Cl.
CPC ..... *B65H 2301/4175* (2013.01); *B65H 2301/41282* (2013.01); *B65H 2301/41446* (2013.01); *B65H 2301/41447* (2013.01); *B65H 2301/41485* (2013.01); *B65H 2301/41722* (2013.01); *B65H 2405/4222* (2013.01); *B65H 2511/22* (2013.01); *B65H 2701/1752* (2013.01)

(56) References Cited

FOREIGN PATENT DOCUMENTS

| | | | |
|---|---|---|---|
| EP | 0905070 | A1 | 3/1999 |
| WO | WO9929480 | A1 | 6/1999 |
| WO | WO2014183887 | A1 | 11/2014 |

* cited by examiner

Fig. 3;

ROLL-REMOVAL DEVICE, WINDING DEVICE AND METHOD FOR TRANSPORTING AWAY A PLURALITY OF ROLLS WHICH HAVE BEEN WOUND TO COMPLETION

The invention relates to a roll-removal device, a winding device according, and a method as described in greater detail below.

Rolls on which films in web form, particularly plastic films, have been rolled, are often held on a winding shaft, in order to be able to treat or process a plurality of individual webs simultaneously.

Subsequently, these wound rolls must be removed from the winding shaft and new rolls must inserted over the winding shaft. For this purpose, generally a displacement device is provided by which the wound rolls can be displaced relative to the winding shaft. This displacement device may have a support surface onto which the wound rolls are placed. Due to static friction between the wound roll and the support surface, the wound roll can be removed from the winding shaft by axially displacing the support surface. To assist in this, holding elements may be provided which prevent slipping of the wound roll on the support surface.

The wound rolls are then transferred to a receiving device which receives them, so that they can then be, e.g., transported further, gathered together, or packaged.

The rolls are transferred from the displacement device to the receiving device, for which purpose the rolls should be freely rollable, at least in certain regions. The means of transferring may be, e.g., pressure means, tilting of the displacement device, or a combination of these.

A problem with this approach, however, is that during the course of free rolling the end faces of the rolls can become caught, making it difficult to roll them in a straight line, and this can ultimately lead to damage to the goods which have been wound onto the rolls.

The object of the present invention is thus to devise a device and a method whereby such damage is avoided.

This object is achieved according to the invention by the features of the claims considered in the aggregate. Possible refinements of the invention are set forth in the drawings and in the description. Features which are described in connection with the inventive devices may be also exploited in connection with the inventive method, and vice versa, so that they may be referred to in a somewhat interchangeable manner.

According to the invention, a device for changing the positions of the roll axes of the rolls is proposed whereby the roll axes of two adjacent rolls can be brought to an angle of less than 180 degrees in relation to each another.

When the rolls are still on the winding shaft, or shortly after they are removed from the winding shaft, the roll axes of two adjacent rolls will be at an angle of 180°. The roll axis of a roll is deemed to be the direction of the main axis of inertia of the roll. The roll rolls around this roll axis when it is rolling in a rolling direction with its peripheral surface on a support surface. If the roll axes of two adjacent rolls subtend an angle less than 180°, this means that their rolling directions are not parallel but occur at an angle greater than 0 degrees. In such an instance, the rolls will roll apart, with their end faces moving farther apart. Under these circumstances, despite the fact that they are freely rolling they will not come into contact and thus will not become stuck; accordingly, it is nearly impossible for the wound goods to become damaged.

According to an advantageous embodiment of the invention, a device for accelerating the rolls is provided. By this it is meant that a force acts on the rolls which causes them to roll in a rolling direction. With such an arrangement it is readily possible to arrange the roll axes of two adjacent rolls at an angle of less than 180°.

According to another advantageous embodiment of the invention, the device for accelerating the rolls comprises a device for tilting a support surface on which the rolls lie. The tilting axis is parallel to or essentially parallel to the axial extent of the winding shaft. This embodiment is particularly advantageous if the support surface has an angular configuration so as to form a trough parallel to the axial direction of the winding shaft. With this arrangement, the rolls are unable to roll in lateral movement relative to the winding shaft. When the support surface is tilted, it is no longer necessary to contribute potential energy to pass over the sides of the trough, in order to cause the rolls to move.

It is particularly advantageous if the device for changing the positions of the roll axes of the rolls is comprised of at least one displacement element which is disposed along a convexly configured line. In this context, the term "convex" means that the ends of the line of rolls which still have their roll axes at 180° are farther than the middle of the line. This displacement device can now influence the rolls in a particularly simple manner, such that the roll axes of two adjacent rolls can be brought to an angle of less than 180°. As a result of the inertia of the rolls, a displacement element with a convexly extending line configuration will roll first, because the displacement element has only a single contact point with the roll, and will rotate it first around a vertical axis before the roll rolls away. To ensure that the described rotation will occur prior to the rolling away, it is advantageous if the described displacement device cooperates with the abovementioned device for tilting. In this case it may be provided that the displacement element acts first on the rolls before the device for tilting is actuated, which latter device will cause the rolls to roll away.

According to a preferred embodiment of the invention, a tube, rod, and/or bar, which may be convexly configured, may be employed. This provides a simple element which can act upon an appreciable number of rolls. It is preferred that the convex configuration be present at least in the projection of the element in the rolling plane of the rolls, so that the above-described effect (of rotation of rolls around a vertical axis) also occurs.

According to another embodiment of the invention, it is provided that the displacement element comprises a roll or wheel the axis of rotation of which is disposed tangentially to the convexly configured line, or is parallel to such a tangent. Use of a roll or wheel affords the advantage that it rolls against the rolls, so that wound goods are minimally damaged.

According to another advantageous embodiment, such rolls may be freely rotatably mounted and/or drivable. If a roll is freely rotatable, it can be readily driven into rotation, so that a drive may be employed to cause the rolls to travel in rolling movement.

Further, it may be provided that the rolls or wheels have a peripheral surface which is comprised of polytetrafluoroethene, at least in some regions. Thereby the adhesion between the wound goods and the roll or wheel is further reduced, thus further reducing the risk of damage.

According to a particularly preferred embodiment of the invention, it is provided that the displacement device and/or the receiving device has/have prominences by means of which the frictional contact of the rolls with the displacement device and/or the receiving device can be reduced, for at least a brief time. In this connection, the surfaces of the prominences preferably have small areas, so as to reduce the contact surface of the rolls with the displacement device and/or the receiving device. Consequently, frictional contact is reduced. An individual roll thus rolls on one or more of these prominences, with the contact surface comprising only a small part of the previous contact surface. This provides a large advantage in particular if the roll is now rotated around a vertical axis. Stated differently, the prominences are particularly advantageous for the situation where the rolls are acted upon by a pushing element having at least one pushing organ disposed on a convexly extending line.

With the above-described embodiment, it is advantageous if at least a part of the prominences is formed in the displacement device and/or the receiving device. This means that these devices and the prominences are comprised of the same material, and the prominences are produced in the material by, e.g., stamping. This may provide a simple and easy means of production.

Since at least some wear will occur on the prominences, it is advantageous if at least a part of the prominences is disposed in or on the displacement device and/or the receiving device, namely said prominences being present as separate components applied at the surface and possibly extending inward. This facilitates replacement. Other suitable materials may also be employed, which provide the rolls with low frictional characteristics.

Thus, it is advantageous if at least a part of the prominences is comprised at least partly of polytetrafluoroethene. This material has particularly low frictional resistance.

According to another advantageous embodiment of the inventive roll-removal device, it is provided that the device for changing the positions of the roll axes of the rolls is disposed on a displacement device by means of which said device can be moved transversely to the axis of the winding shaft. This displacement device may be regarded as a concretization of the more generalized displacement device described above, wherewith the particular displacement device here is capable of an essentially linear movement. A wide variety of drive means are available which could be used to generate such linear movement. The preferred such drive means comprise a compressed air cylinder, which is advantageous from the standpoint of purchasing and also maintenance.

According to an advantageous improvement according to the invention, the displacement device has rails disposed on both sides of the support surface, with slides being provided which can be moved over said rails. The slides bear the device for changing the positions of the roll axes of the rolls.

As mentioned above, the object of the invention is also achieved by a method; according to the method, the roll axes of two adjacent rolls can be brought to an angle of less than 180 degrees in relation to each another, by means of a device for changing the positions of the roll axes of the rolls.

Additional exemplary embodiments of the invention will be apparent from the description, and the drawings.

Figure 1:
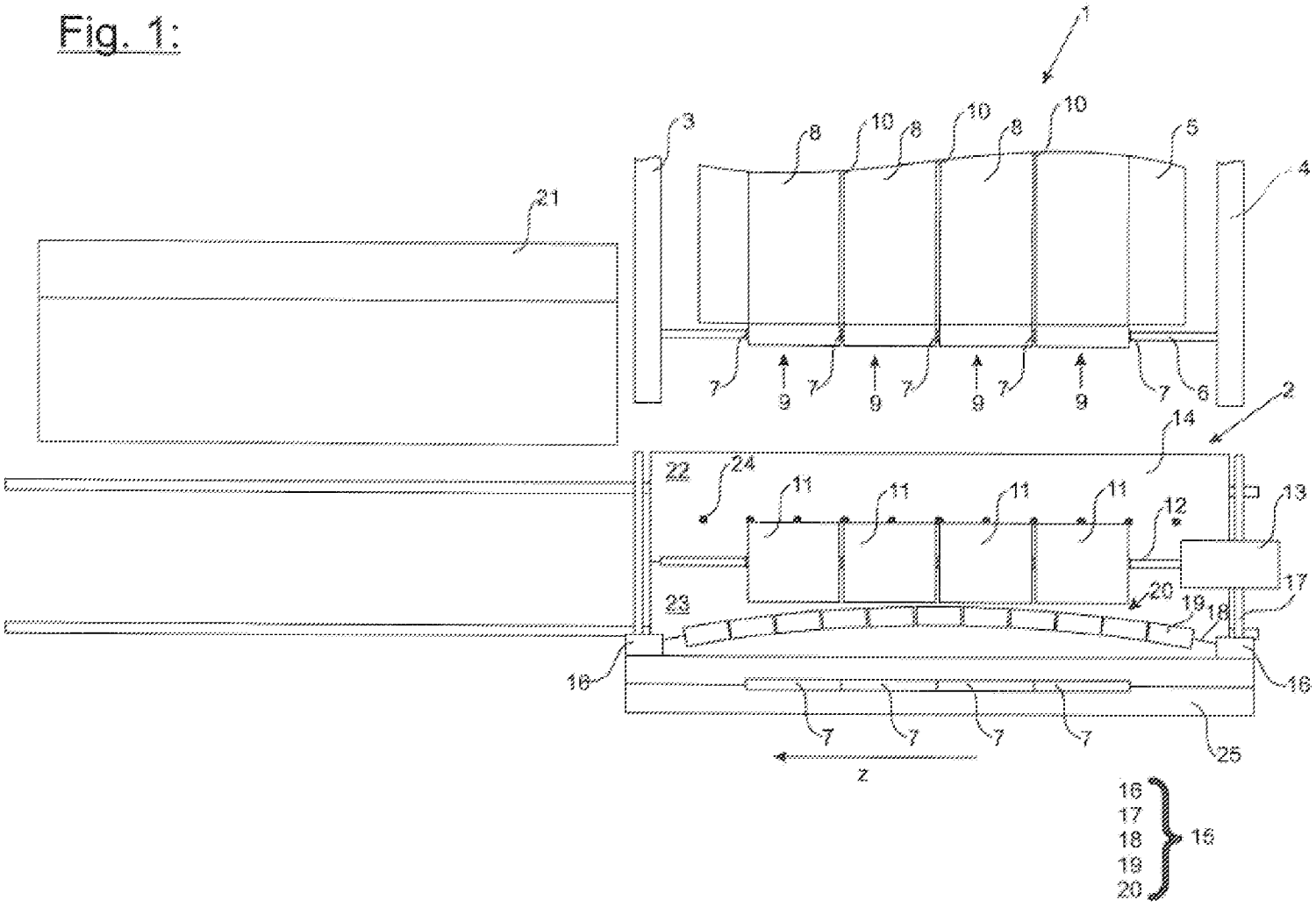
FIG. 1 illustrates a roll-removal and winding device, following the removal of rolls.

FIG. 1 illustrates a winding device 1 and a roll-removal device 2. The winding device comprises as components two parts of a machine frame 3, 4, in which a web guiding roll 5 is rotatably mounted, which roll 5 is the last roll over which the at least one web of material runs before it reaches the winding roll. The web guiding roll is often not mounted directly in the described parts of the machine frame. It may also be mounted in intermediate frame elements in order to be movable with respect to the machine frame. The web guiding rolls 5 may be contact rolls. With such a contact roll, the web of material is guided to the winding roll in such a way that a defined quantity of air is included between the individual layers of the winding. For this purpose, a defined distance is established between the web guiding roller and the winding roll.

A winding shaft 6 is illustrated. The shaft 6 is shown as being rotatably mounted in the parts 3, 4 of the machine frame; however, this is a simplified representation. As a rule, the winding shaft is rotatably mounted in auxiliary frames, so as to be movable radially and/or in the circumferential direction of the web guiding roll. Movement in the circumferential direction is needed, e.g. in the course of an automatic change of rolls. The adjustability in the radial direction relative to the web guiding roll 5 is needed in order to be able to adjust the above-described distance between the web guiding roll 5 and the winding shaft 6.

The winding shaft 6 bears one or more winding cores 7, four such winding cores being shown in the present exemplary embodiment. At the point in time illustrated, the winding cores have several layers of material web wound onto them, wherewith each winding core 7 is associated with a specific material web 8. A winding core 7 and the associated and already wound part of the material web 8 form a "winding roll" 9. The material webs 8 as a rule are generated from a single web of material. In order to prevent contacting of the edges of a material web which has been separated into separate individual material webs 8, the material webs 8 are disposed at a distance 10 from each other, on the web guiding roll 5. This distance in each case is often set up by cutting out and removing a narrow strip from a material web, between two material webs 8. The individual winding cores 7, however, are in contact with each other, wherewith ultimately the end faces of the winding cores extend outside of the ends of the wound material webs.

Winding rolls 11 which have been wound to completion and which have been removed from the winding device 1, are disposed on the roll-removal device 2, which is illustrated in FIG. 1 opposite to the winding device 1, and have their winding cores still in the pushed-on state on the respective associated winding shaft 12, which is to say that the winding shaft 12 is still pushed into the winding cores. Under these circumstances, the winding shaft 12 has one of its ends held in a holder 13, with the winding shaft 12 and the holder 13 being couplable together and also separable from each other, whereby the holder 13 can receive a winding shaft 12 with rolls which have been wound to completion, from the winding device 1.

Due to the generally high weight of the rolls, the holder 13 cannot hold them via the winding shaft, but rather the rolls rest on a receiving table 14 which is trough-shaped so that the rolls cannot accidentally roll off of the receiving table 14.

The roll-removal device 2 can be mounted on roller conveyors or rails, and can be displaced by means of wheels in the direction of the arrow z.

In addition, the roll-removal device 2 is comprised of a transfer device 15 by means of which the rolls 11 can be passed to a receiving device 21.

The receiving device may in turn transfer the rolls to a transporting device for removal or for further transport, or may transfer them to a packaging machine for packaging the rolls. The receiving device may itself serve for the further transport function.

The transfer device 15 comprises, as core elements, slides 16 which are movable on rails 17 disposed on both sides of the receiving table 14. For this purpose, a drive is. Between two slides, a pushing device 20 is provided. In the exemplary embodiment illustrated, it is comprised of a curved rod 18, the point of maximum deviation which, located approximately midway between the slides 16, and regarded in the y-direction, comes closest to the trough of the receiving table 14 and thereby closest to the rolls. From there, the rod, regarded in the direction of the slides, becomes increasingly more distant from the rolls 11. Small rolls 19 are provided which are freely rotatable on the rod and which taken together overall have a convex shape contributed by the rod. In place of the rolls, small wheels may be provided. It is advantageous if the rolls 19 or the wheels are very easy to move, wherewith thus they will not damage the rolls 11 when they contact said rolls.

The slides may also bear a support element 25 which, similarly to the receiving table 14, is trough-shaped; empty winding cores 7 are placed on said support element. These winding cores 7 are available as replacements when changing winding rolls.

The roll-removal device 2 may further be configured so as to tilt the receiving table 14. For this purpose, a device is provided for producing a tilting force, which device operates by causing a lowering of the side 22 of the receiving table which faces away from the pushing device 20 and/or a raising of the side 23 of the receiving table which faces toward the pushing device 20 (where the notions of "facing away from" and "facing toward" are regarded from the position of the rolls 11); in this way, the rolls can be rolled off of the receiving table.

The side 22 of the receiving table 14 which faces away from the pushing device is provided with burl-like prominences 24 which extend out of the surface of the receiving table 14. These nubs are advantageously arranged along a line which runs essentially parallel to the trough. They may be inserted in and fixed in holes in the receiving table. Also it is possible for them to be of unit construction with the receiving table.

Figure 2:
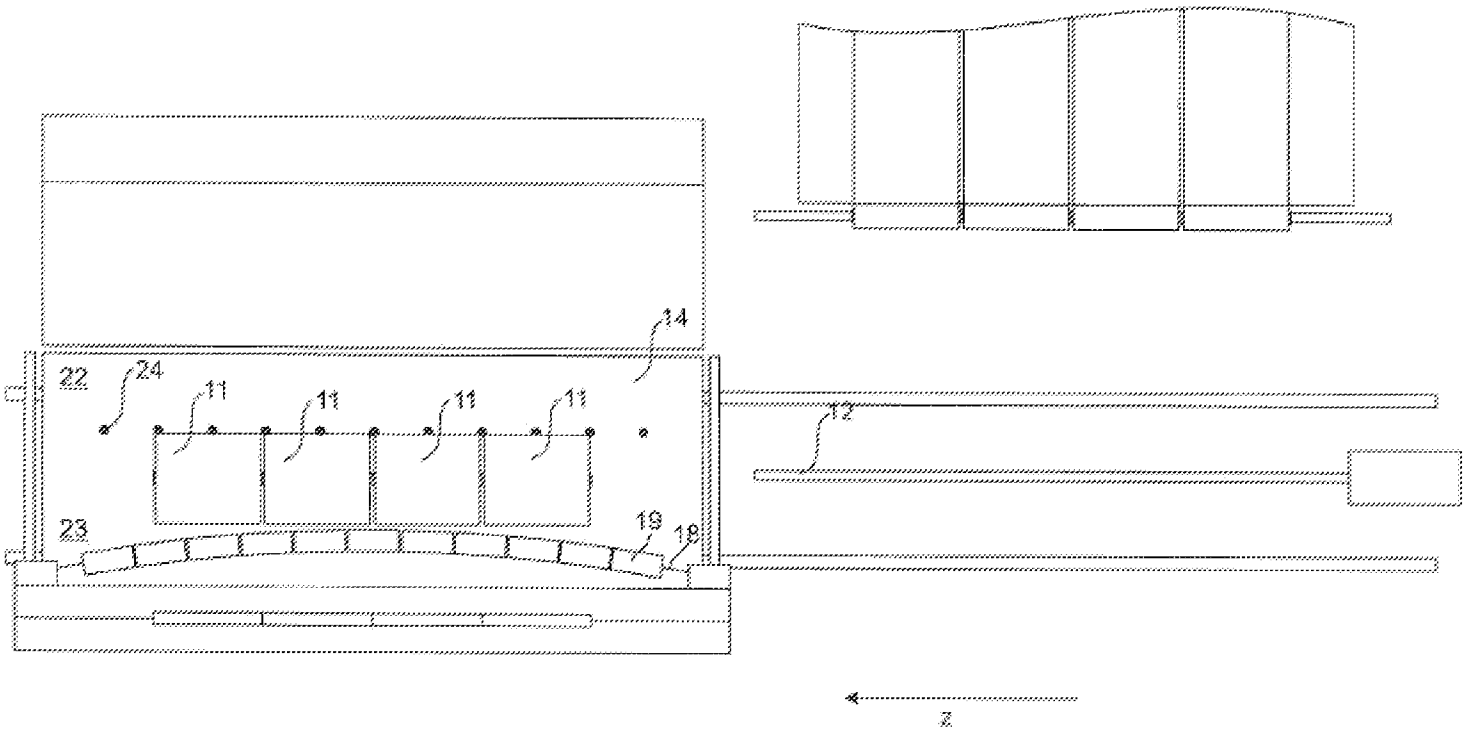
FIG. 2 illustrates a roll-removal and winding device, following the removal of rolls, with the receiving table being displaced.

Changing of the rolls, and in particular transfer of the rolls 11 to the receiving device 21 will now be described, with reference to FIGS. 1 to 5. A significant feature of the roll changing in the winding device 1 is that the winding shaft 12 is slightly separated from the web guiding roll, so as to give rise to a gap. The new winding shaft 6 with the winding cores 7 already pushed onto it is disposed against the material webs 8, slightly upstream. Then separate steps comprising cutting to separate the material webs 8 and winding of the newly formed material web starting regions onto the winding cores 7 are carried out. These web starting regions are caused to adhere to the new winding cores 7 by known means, e.g. by adhesive bonding materials or electrostatic forces. The winding shaft 12 with the winding rolls 11 is placed on the receiving table 14 by a device, such that the winding shaft 12 is received by the holder 13. Then the overall roll-removal device 2 is moved in the direction of the arrow z. Since the holder is not displaceable, at least in the axial direction of the rolls 11, or is at least held so as to be not displaceable, the described movement also causes the winding shaft 12 to be withdrawn from the winding cores. At this point, the rolls 11 are subjected to only a support force which is applied by the receiving table 14. As illustrated in FIG. 2, the roll-removal device 2 has been displaced over the entire displacement path.

Figure 3:
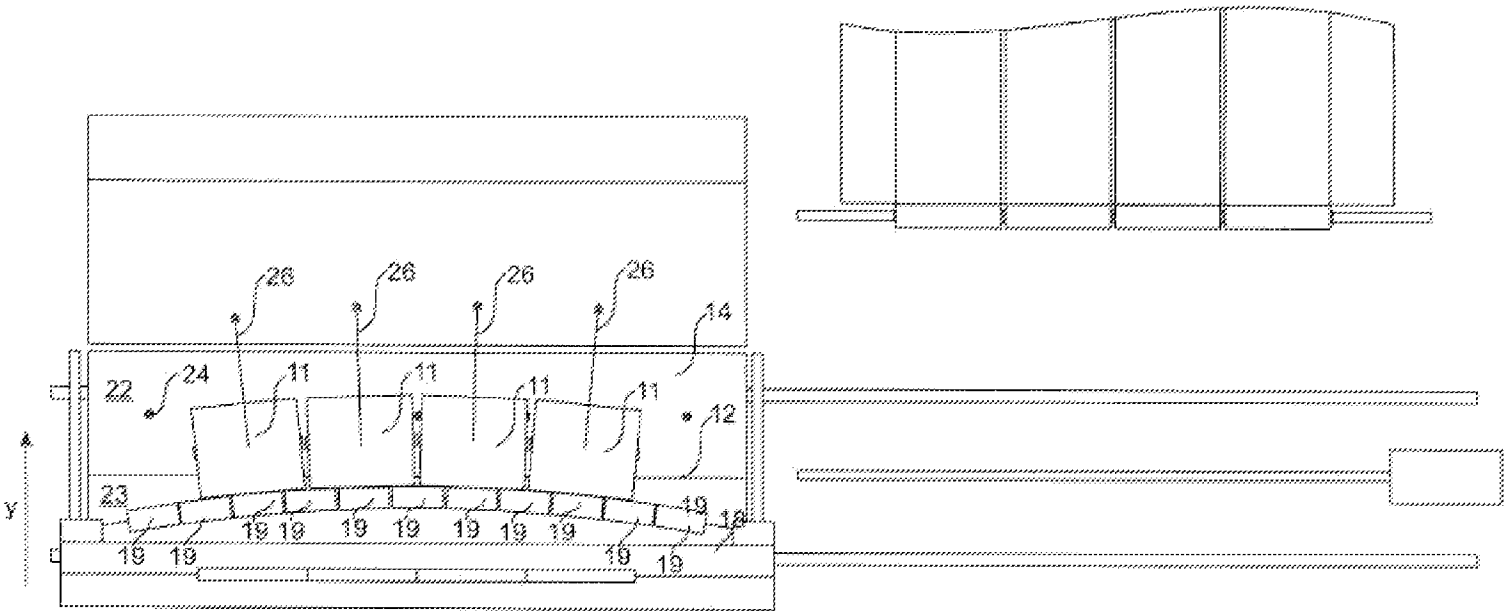
FIG. 3 illustrates a roll-removal and winding device during expelling of the rolls.

Next, as illustrated in FIG. 3, the transfer device 15 is moved in the direction of the arrow y, so that now the pushing device 20 engages the rolls, wherewith the rolls 19 come into contact with the rolls 11. The contacting occurs first with the rolls 11 which are disposed in the region of the point of maximum deviation of the pushing device. These are accordingly caused to rotate around their roll axes. This movement is superposed over a rotational movement around a vertical axis associated with the given roll 11, which is essentially caused by the fact that the contact is initially active only in the region of one end of a roll, wherewith for the described rotation of this roll less force is required than for the pushing of the rolls. In order to keep the force of the described rotation low, the nubs described above are provided. The rolls run on these nubs, which facilitates the described rotation. However, the opposite case can also occur, with the rolls initially being pushed somewhat away and then, after a given roll comes up against one or more of the nubs, the roll undergoes rotation, in consequence of the now temporarily reduced adhesion force.

When the pushing device is moved farther, other rolls are also engaged in the described manner.

Regardless of whether a movement away resulting from pressing occurs first or the described rotation occurs first, the effect will be that the roll axes of the rolls will no longer be aligned, and will no longer subtend a 180° angle. Instead, the rotational axes will form a set of tangents which are disposed along a curved line analogous to the rod 18. Accordingly, pairs of these rotational axes will subtend between them an angle of less than 180°. The aggregate effect of this is that the rolls roll in slightly different directions. These rolling directions are represented in FIG. 3 by the arrows 26. Ordinarily, the rolling directions will each be a direction perpendicular to the roll axis of the given roll. Based on the described disposition of the roll axes, the rolls 11 will be observed to move apart as they are rolled away. Accordingly, one avoids jamming of the rolls during the rolling-away process, and thereby one reliably avoids the risk of damage.

In the described process, tilting of the receiving table 14 can have a beneficial effect. This procedure is advantageous because then the pushing device does not by itself have to apply all of the force for instituting the movement of the rollers 11. Excessive pressure applied to the rolls by the rolls 19 could damage the former. Moreover, without the assistance of the tilting, the rod 18 might need to be made more massive.

Figure 4:
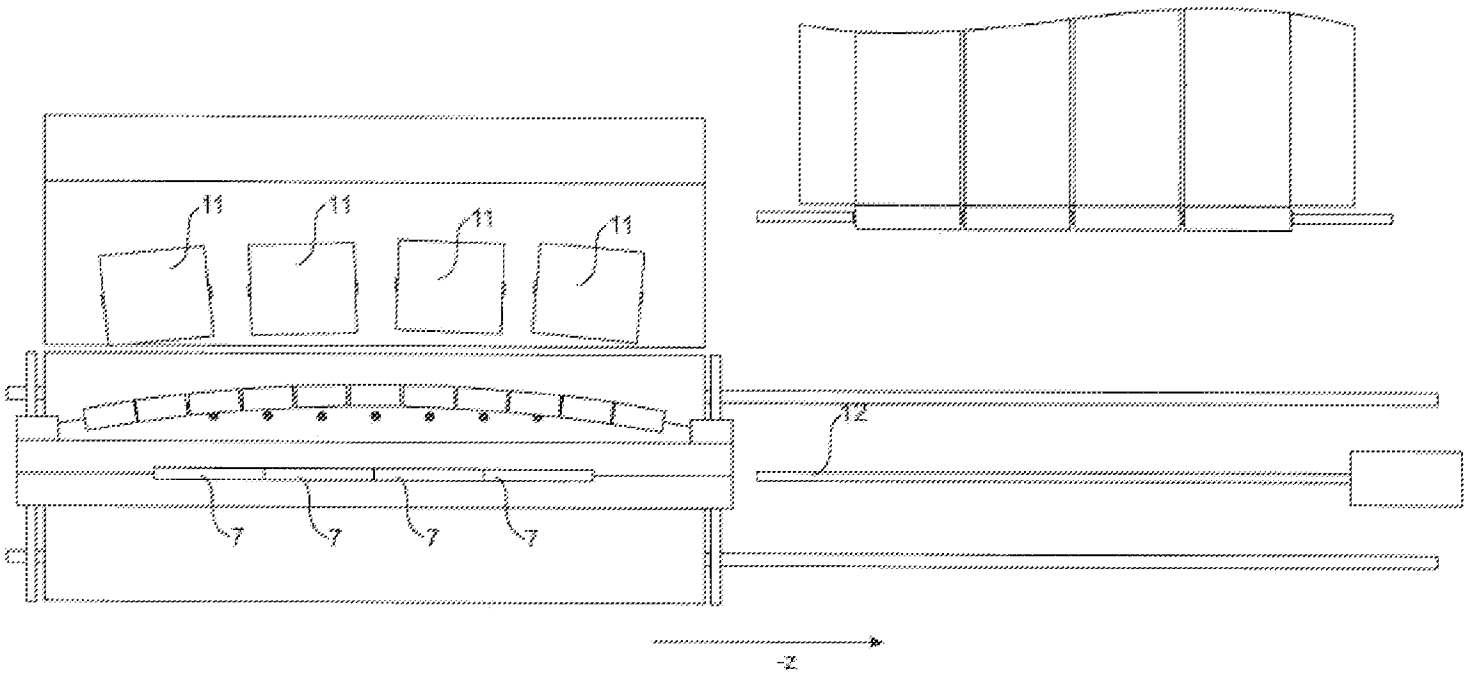
FIG. 4 illustrates a roll-removal and winding device following positioning of the new winding cores.
Figure 5:
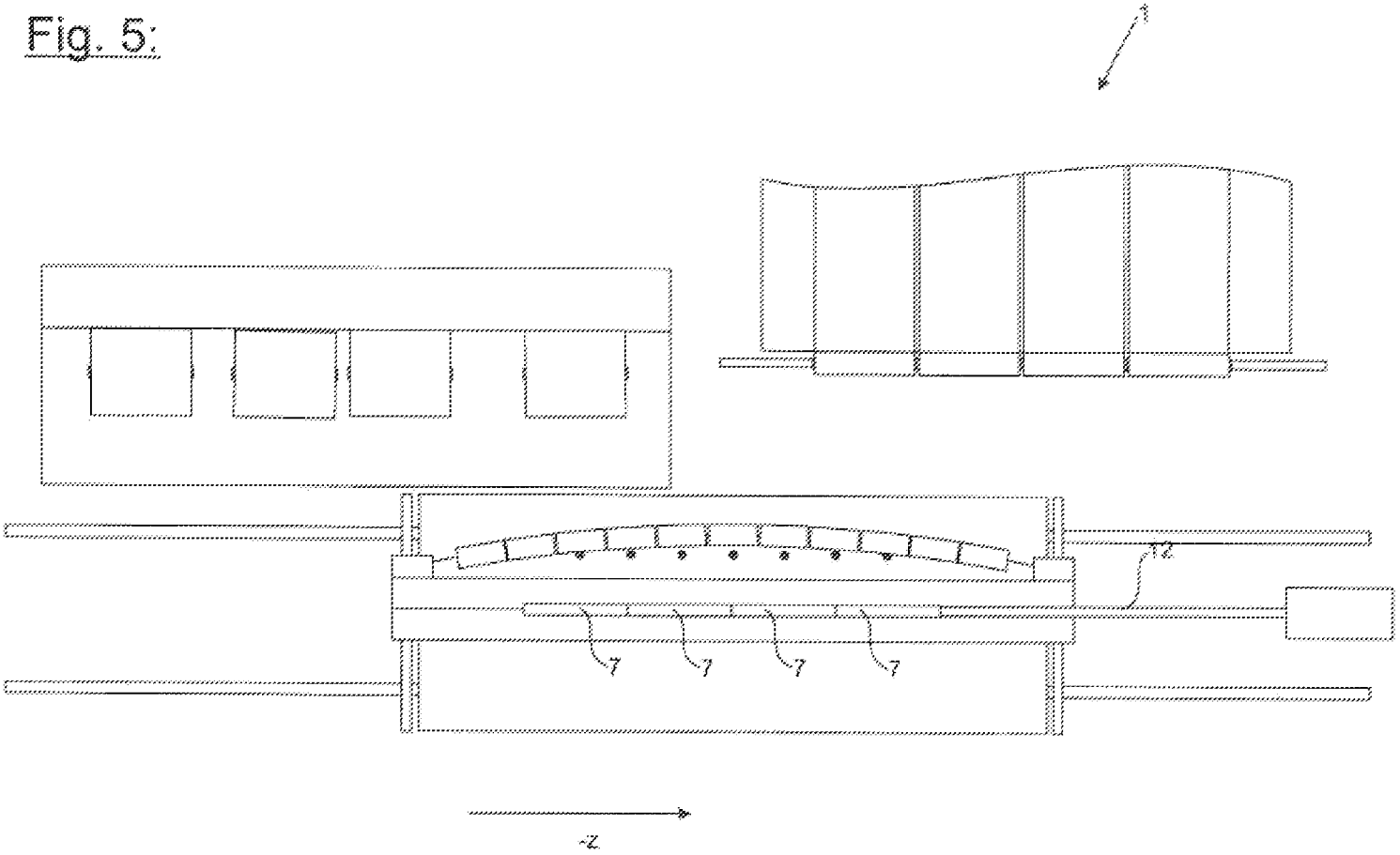
FIG. 5 illustrates a roll-removal and winding device during the installation of the new winding cores.

FIG. 4 illustrates the situation when all of the rolls have been completely rolled off onto the receiving device 21. FIG. 4 further shows that the transfer device 15 has moved so far in the direction of the arrow y that the axes of the winding cores 7 and the axis of the winding shaft 12 are aligned with each other. In other words, the winding cores and the winding shaft are mutually aligned, wherewith they can be axially pushed together by pushing the winding cores 7 onto the winding shaft 12, namely by displacing the winding cores 7 in their axial direction (the direction z). This process is illustrated in FIG. 5. This leaves behind a winding shaft bearing winding cores, which can be transferred back to the winding device 1. Now it is possible to carry out the next changing of the winding rolls.

Figure 6:
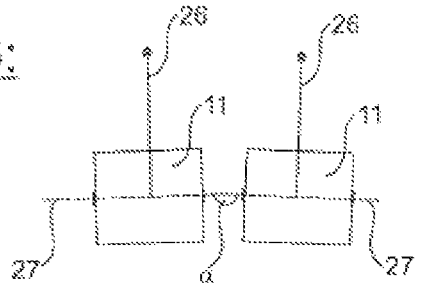
FIG. 6 illustrates the positioning of two rolls with respect to each other after changing of their positions.

FIG. 6 once again illustrates the dispositions of the rolls after the change of position. The two rolls 11 in this Figure are also characterized by their roll axes 27, which are their principal axes for load bearing purposes. The roll axes 27 (indicated with dashed lines) subtend an angle α which, according to the invention, is smaller than 180° following the change of position. This means that the directions of movement indicated by the arrows 26 are no longer parallel but are directed apart.

In the described manner not only is a roll-removal device provided, but also a winding system with a winding roll changing device and a roll-removal device.

In the preceding description of the drawings, and also in the descriptions prior to that, various features have been described in conjunction with other features. However, any combination of features is possible, and such combinations may be employed, to the extent that they are practicable.

LIST OF REFERENCE NUMERALS

1 Winding device.
2 Roll-removal device.
3 Machine frame.
4 Machine frame.
5 Web guiding roll.
6 Winding shaft.
7 Winding core.
9 Web of material.
10 Distance between webs of material.
11 Rolls (i.e. winding rolls).
12 Winding shaft.
13 Holder.
14 Receiving table.
15 Transfer device.
16 Slides.
17 Rails.
18 Rod.
19 [Small] roll.
20 Pushing device.
21 Receiving device.
22 Side facing away from the pushing device 20.
23 Side facing toward the pushing device 20.
24 Nub elements (burl-like prominences).
25 Support element.
26 Arrow.
27 Roll axis.
y (Directional arrow.)
z (Arrow.)
α (Angle.)

The invention claimed is:

1. A roll-removal device by means of which a plurality of rolls which have been wound to completion are transported away from a winding shaft, which device is comprised of the following:

a displacement device for displacing the rolls relative to the winding shaft, in order to withdraw the rolls from the winding shaft, wherein the displacement device has prominences that contact the roll;

a receiving device for receiving the rolls; and a transfer device for transferring the rolls from the displacement device to the receiving device, wherein the rolls can be rolled freely at least in certain regions, the rolls rolling about their rolling axes;

wherein a device for changing the positions of the roll axes of the rolls, whereby the roll axes of two adjacent rolls can be brought to an angle (α) of less than 180 degrees in relation to each another.

2. The roll-removal device according to claim 1; wherein the transfer device is comprised of a device for accelerating the rolls.

3. The roll-removal device according to claim 2; wherein the device for accelerating the rolls comprises a device for tilting a support surface on which the rolls are resting, with the tilting axis being oriented essentially parallel to the axial extent of the winding shaft.

4. The roll-removal device (2) according to claim 1; wherein the device for changing the positions of the roll axes of the rolls is comprised of at least one displacement device having at least one displacement element which is disposed along a line having a convex configuration.

5. The roll-removal device according to claim 4; wherein the displacement element is comprised of a convexly configured tube or rod.

6. The roll-removal device according to claim 5; wherein the displacement element is comprised of a roll or wheel having an axis of rotation which is disposed tangentially to the convexly configured line.

7. The roll-removal device according to claim 6; wherein the roll or wheel is freely rotatably mounted and/or drivable.

8. The roll-removal device according to claim 6; wherein the roll or wheel has a peripheral surface which is comprised of polytetrafluoroethene, at least in some regions.

9. The roll-removal device according to claim 1; wherein the prominences reduce frictional contact of the rolls with the displacement device is reducible, for at least a brief time.

10. The roll-removal device according to claim 9; wherein at least a part of the prominences is formed in the displacement device.

11. The roll-removal device according to claim 9; wherein at least a part of the prominences is comprised at least partly of polytetrafluoroethene.

12. The roll-removal device according to claim 1; wherein at least a part of the prominences is disposed in or on the displacement device as separate components.

13. The roll-removal device according to claim 1; wherein the device for changing the positions of the roll axes of the rolls is disposed on a displacement device by means of which the winding shaft is disposed transversely to the axis can be moved.

14. The roll-removal device according to claim 1; wherein the displacement device is comprised of rails disposed on both sides of a support surface, having slides which are movable on the rails, which slides bear the device for changing the positions of the roll axes of the rolls.

15. A winding device, comprised of:

a winding shaft on which at least two rolls can undergo winding, in a winding position;

a feed device whereby webs of material can be fed to the rolls; and a transfer device whereby the winding shaft can be removed from the winding position and transported to a roll-removal device; and a roll-removal device according to claim 1.

16. A method whereby a plurality of rolls which have been wound to completion are transported away from a winding shaft, said method employing the roll-removal device according to claim 1 and having the following steps:

the rolls are displaced relative to the winding shaft, by means of a displacement device, in order to withdraw the rolls from the winding shaft;

the rolls are received by a receiving device; and the rolls are transferred from the displacement device to the receiving device, by means of a transfer device wherein the rolls can be rolled freely at least in certain regions, the rolls rolling about their rolling axes; wherein the roll axes of two adjacent rolls can be brought to an angle ($\alpha$) of less than 180 degrees in relation to each another, by means of a device for changing the positions of the roll axes of the rolls.

* * * * *